US005513624A

United States Patent [19]

Vorhis

[11] Patent Number: 5,513,624

[45] Date of Patent: May 7, 1996

[54] WEIGHTED NEEDLE FOR CLEANING FUEL ORIFICE OF LIQUID FUEL COMPONENT STOVE

[75] Inventor: Daniel J. Vorhis, Seattle, Wash.

[73] Assignee: Mountain Safety Research, Seattle, Wash.

[21] Appl. No.: 267,797

[22] Filed: Jun. 29, 1994

[51] Int. Cl.[6] ..... F24C 5/20

[52] U.S. Cl. ..... 126/38; 126/40; 431/123; 137/244; 239/117

[58] Field of Search ..... 126/39 R, 38.40, 126/41 R; 137/244; 431/122, 123, 344; 239/117

[56] References Cited

U.S. PATENT DOCUMENTS

| | | | |
|---|---|---|---|
| 1,278,620 | 9/1918 | Ferguson | 431/123 |
| 1,338,633 | 4/1920 | Johnston, Jr. | 239/117 |
| 1,360,232 | 11/1920 | Lacko | 431/122 |
| 1,463,101 | 7/1923 | Straub et al. | 431/123 |
| 1,503,042 | 7/1924 | Gosmann | 431/122 |
| 1,975,192 | 10/1934 | Chadwick et al. | 431/122 |
| 2,344,758 | 3/1944 | Welsh | 431/122 |
| 2,363,098 | 11/1944 | Tullis | 431/123 |
| 2,449,927 | 9/1948 | Checkon | 239/117 |
| 2,478,364 | 8/1949 | Bramming | 126/38 |
| 2,613,992 | 10/1952 | Bahnson, Jr. | 239/116 |
| 2,628,674 | 2/1953 | Fore | 431/121 |
| 2,633,189 | 3/1953 | Pyle | 431/122 |
| 2,792,058 | 5/1957 | Thomas et al. | 431/122 |
| 3,175,601 | 3/1965 | Knapp et al. | 431/123 |
| 3,900,281 | 8/1975 | Penberthy | 431/344 |
| 4,230,446 | 10/1980 | Fisher | 431/123 |

FOREIGN PATENT DOCUMENTS

| | | | |
|---|---|---|---|
| 1061052 | 4/1954 | France | 431/123 |
| 52835 | 2/1942 | Netherlands | 431/123 |
| 100733 | 1/1941 | Sweden | 431/123 |

OTHER PUBLICATIONS

"Comparison Chart," *Sports Afield:* 93–94, Mar. 1992.

*Primary Examiner*—James C. Yeung
*Attorney, Agent, or Firm*—Seed and Berry

[57] ABSTRACT

An apparatus and method for cleaning a fuel delivery system contained within a lightweight, portable, liquid fuel component stove comprising a weighted needle contained within a fuel transmission chamber wherein shaking the chamber causes a cleaning end of the weighted needle to move in and out of an orifice in the chamber, so that the orifice is cleaned and fuel may be effectively transmitted from a fuel source through the orifice and to a burner.

8 Claims, 3 Drawing Sheets

WEIGHTED NEEDLE FOR CLEANING FUEL ORIFICE OF LIQUID FUEL COMPONENT STOVE

FIELD OF THE INVENTION

The field of the present invention is cleaning needles for a fuel orifice of lightweight, portable, liquid fuel component stoves.

DESCRIPTION OF THE RELATED ART

It is common in the field of lightweight, portable, component, liquid fuel stoves suitable for backpacking, to have clogging problems with the orifice that delivers fuel from the fuel line or other fuel system to the burner. The clogging may be caused by a buildup from the fuel itself, such as coke formation, or the clogging may be caused by dirt or other extraneous material in the fuel or environment.

One type of prior method and device for cleaning the orifice is a wire that is disposed inside the fuel delivery tube, and then moved in and out of the orifice by means of a crank at the distal end of the tube. Another method and apparatus has been to move the needle in and out of the orifice by means of turning an external crank, which in turn moves the needle by a means of a rack and pinion.

However, these methods require multiple moving parts, gearing, and seals. These pans can break or wear out. Additional seals are expensive, particularly if they must function in high temperatures, and pose the additional risk of potentially dangerous fuel leaks.

Another approach has been to poke a needle through the orifice from the outside, which needle is not otherwise attached to the burning unit. However, such a cleaning approach can cause the detritus located in the orifice to be pushed back into the fuel delivery system, where it may continue to clog the orifice. Further, the external needle is separate from the burning unit and therefore may be lost, and the cleaning operation requires precise and delicate manipulation, which may be difficult or impossible in the cold or in other conditions wherein the stove is expected to function.

Still another approach, which has been used with single unit burning appliances, is the use of a pin weighted at one end, where the pin is shaken in and out of a fuel jet. However, such appliances are typically not of a convenient size and weight for shaking, and the shaking can increase the possibility of fuel spillage from the non-component appliance.

The present invention provides a weighted cleaning needle suitable for use in a lightweight component stove, and other related advantages.

SUMMARY OF THE INVENTION

The present invention is directed to an apparatus and method suitable for cleaning an orifice in the fuel delivery system of a lightweight, portable, liquid fuel, component stove without the use of any external cranks, or other external device, to move the cleaning needle. By lightweight, it is meant that the component stove is suitable for backpacking and other outdoor activity. Because there is no external crank, the present invention also does not require any external seals. Further, the present invention allows cleaning of the orifice using only one hand, and in a preferred embodiment, the present invention automatically terminates the flow of fuel to the burner upon tipping over or inversion of the stove.

Thus, in a first aspect, the present invention provides a weighted needle that is located in a chamber proximal to the orifice that delivers fuel to the burner of a lightweight, portable, liquid fuel, component stove. The weighted needle has a weighted end and a cleaning end. Upon shaking, the cleaning end of the needle enters the orifice in an in and out motion, thereby pushing clogging detritus out of the orifice.

In a preferred embodiment, because of the weight of the needle, gravity causes the weighted needle to rest upon the bottom surface of the chamber containing the needle when the stove is stationary and upright, thereby removing the cleaning end of the needle from the orifice, and allowing a flow of fuel to the burner.

Preferably, the cleaning end of the weighted needle is generally cylindrical in shape and is sized to closely fit the orifice such that upon shaking, the needle closely conforms to the sides of the orifice. This removes as much detritus as possible.

In a further preferred embodiment, upon inversion or tipping over, the weighted needle effectively terminates the flow of fuel to the burner, thereby turning off the burner.

In a further aspect, the needle may be sized so as to provide a metering of fuel flowing through the orifice, thereby allowing a proper amount of fuel to exit the orifice at a proper velocity such that air may be mixed in an effective quantity via an opening in a tube adjacent to the burner.

DESCRIPTION OF THE PREFERRED EMBODIMENTS

The present invention is directed towards a weighted needle for cleaning the fuel orifice of a lightweight, portable, liquid fuel component stove. The use of such a cleaning needle in conjunction with a component stove is advantageous because the weighted needle is located within a chamber leading to the fuel orifice, and therefore removes the need for any external seals, cranks, or other secondary structures. Further, the burner assembly of the component stove can be detached from the fuel container either before or after cleaning. Cleaning is highly preferably performed by shaking the burner assembly when it is detached from the fuel container because the burner assembly is a more convenient size and weight for shaking than an entire stove, and this reduces the possibility of spilling fuel. Further, in order to obtain full cleaning of the orifice, it is often necessary to "rap" the burner assembly, upside-down, sharply on a solid surface. The "rap" thus generates enough velocity in the weighted needle to push through the carbon build-up. With a large appliance or a stove with an attached fuel container, it can be difficult to "rap" the burner assembly without damaging the appliance and/or causing fuel leakage. Further, with a lantern such a "rap" can easily cause the fragile mantle(s) to break.

The use of the weighted needle for cleaning the fuel orifice is also particularly advantageous with the use of liquid fuels, as "dirty" liquid fuels are often the only fuels available in remote areas and foreign lands, thereby dramatically increasing the need to clean the fuel orifice. The weighted needle is further particularly advantageous for use with component stoves having a separated burner assembly and fuel tank because the weighted needle is typically maintained in a vertical chamber to take advantage of the effects of gravity to remove the needle from the cleaned orifice when not in use, and such a chamber is typically located below the burner itself. Thus, where the fuel container is located below the burner assembly, the burner assembly can become fairly tall and the stability of the stove can be reduced.

Figure 1A:
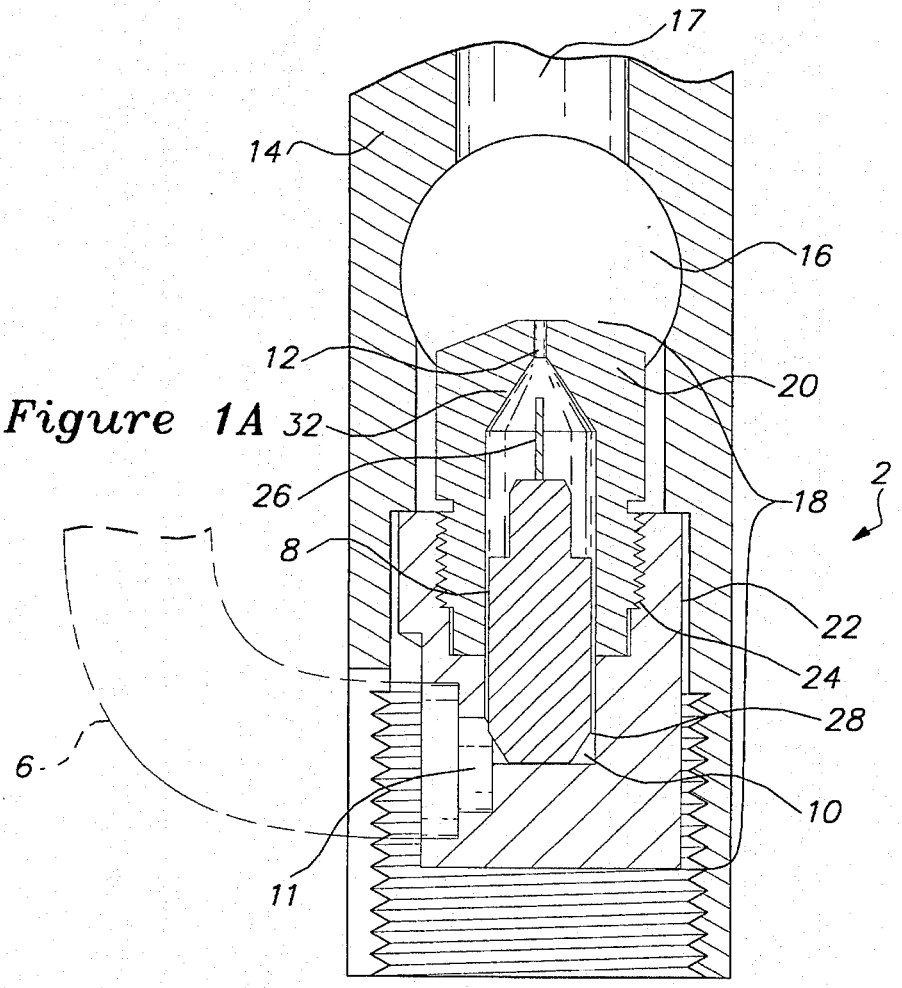
FIG. 1A depicts a side, cross-sectional view of the chamber and the weighted needle.
Figure 4:
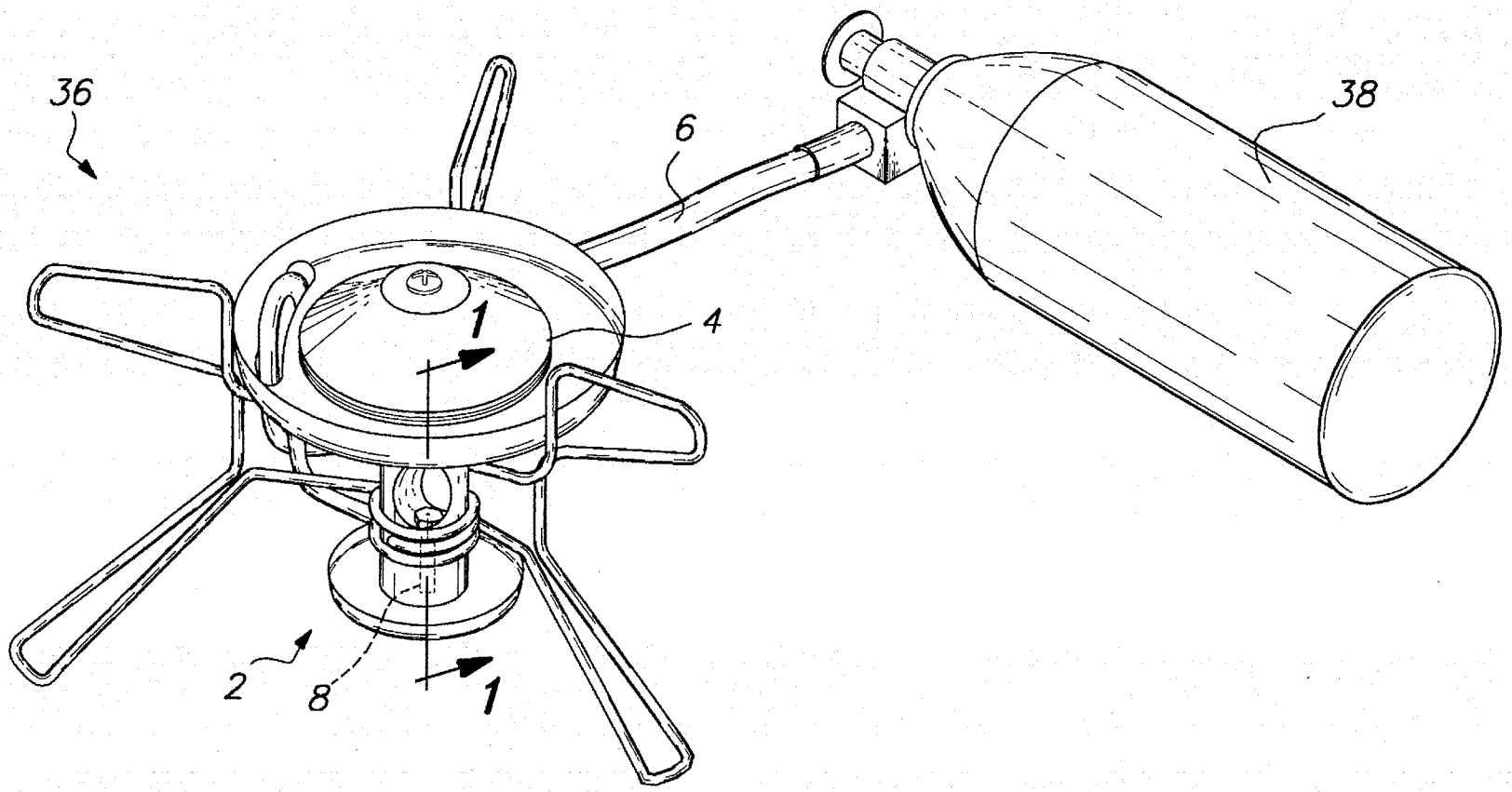
FIG. 4 is a side view of a lightweight, portable, liquid fuel component stove showing the weighted needle contained therein.

FIG. 1A depicts an embodiment of the present invention for use in a liquid fuel, component stove having a fuel delivery system 2, which would preferably be located below a burner. By "component," it is meant a portable, liquid fuel stove wherein the burner assembly is removably attached to the liquid fuel container, so that the stove may be "broken down" into components for cleaning by shaking without shaking the entire stove (although not preferred, the entire stove, including all attached components, may be shaken to effect cleaning). Such a component stove may also be "broken down" for insertion into a backpack, and, when the stove is connected, the burner assembly may be positioned a distance from the fuel container during use. An example of such a component stove is depicted in FIG. 4. By "liquid fuel," it is meant a fuel such as white gas, unleaded gas or kerosene, wherein the fuel is liquid at ambient temperatures and pressures, such as 25° C. and 1 atmosphere, and therefore the stove does not require the type of pressurized fuel container commonly found with butane, isobutane and propane stoves.

Figure 1B:
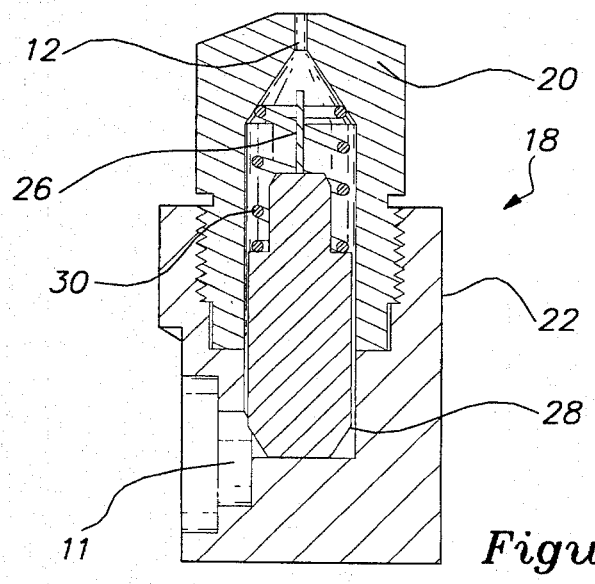
FIG. 1B depicts a side, cross-sectional view of an alternative embodiment having a spring.

The fuel delivery system 2 comprises a tube 14 containing a housing 18, and housing 18 in turn contains a chamber 10. In alternative embodiments, housing 18 may be connected directly to the burner, or tube 14 may sit atop housing 18. The chamber 10 has an opening 11 able to transmit fuel from a fuel line 6, which is in turn attached to a stand alone, detachable fuel container. The fuel is a liquid fuel such as white gas or kerosene. In a preferred embodiment, the housing 18 has an upper section 20 and a lower section 22 that may be attached to each other by threads 24. This arrangement permits easy placement of the weighted needle 8 in the chamber 10. The weighted needle 8 is slidably contained within chamber 10, but is typically not attached thereto. The sizing of the needle and chamber guides the needle to smoothly reciprocate in the orifice 12. Because the weighted needle 8 is loose within the chamber 10, it is able to be shaken such that the cleaning end 26 of the weighted needle 8 is able to be moved in and out of orifice 12, which orifice 12 is preferably located at an end of chamber 10 proximal to the burner. In an alternative embodiment, as depicted in FIG. 1B, the weighted needle may be attached to the chamber 10 by means of a spring 30 disposed between the end of chamber 10 having the orifice 12 and the weighted needle 8. In such an embodiment, shaking the weighted needle 8 causes the cleaning end 26 to removably enter orifice 12, but the force of the spring 30 removes the cleaning end 26 from orifice 12 when not shaken. Further, by use of such a spring, gravity is not needed to maintain the weighted needle removed from the orifice 12. In another alternative embodiment, cleaning end 26 of weighted needle 8 is of such a length that it remains in orifice 12 when stationary and/or upright. In such an embodiment, orifice 12 is oversized to allow fuel to be transmitted therethrough.

Returning to FIG. 1A, in a preferred embodiment, orifice 12 connects chamber 10 to an opening 16 which is connected in turn to passage 17, which leads to the burner. The opening 16 enables air to be mixed with fuel transmitted by orifice 12 such that more complete and effective burning of the fuel is attained at the burner.

In a further preferred embodiment, the cleaning end 26 of the weighted needle 8 is sized to closely fit orifice 12 such that, upon entering orifice 12, the cleaning end 26 closely conforms to the sides of orifice 12. Because of such sizing, cleaning end 26 can effectively remove detritus in orifice 12 such that fuel may be transmitted therethrough.

It is a further aspect of the invention that when the chamber 10 and, therefore, the portable fuel delivery system 2 and the burner are tipped over or inverted, gravity and/or motion cause the weighted needle 8 to block orifice 12, thereby effectively terminating the flow of fuel through the orifice 12 such that the flame at the burner is extinguished.

In an even further preferred embodiment, chamber 10 has a generally conical shape 32 at an end of the chamber located proximal to orifice 12 so that the cleaning end 26 of weighted needle 8 is guided by the generally conical shape 32 into the orifice 12.

Figure 2:
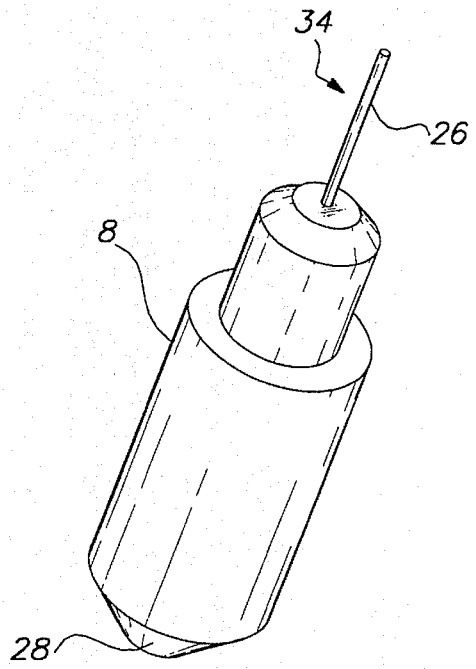
FIG. 2 is an isometric side view of the weighted needle.

Turning to FIG. 2, an isometric view of the weighted needle 8 is depicted. The weighted needle has a cleaning end 26 and a weighted end 28. Further, in a preferred embodiment, the cleaning end 26 has a generally cylindrical shape 34, such that the weighted needle may closely conform to the sides of orifice 12 when the orifice is generally circular in shape. The generally cylindrical and circular shapes also provide the advantage of easier manufacturing, in that the orifice may be simply drilled as opposed to molded or otherwise formed to attain a non-circular shape.

Figure 3:
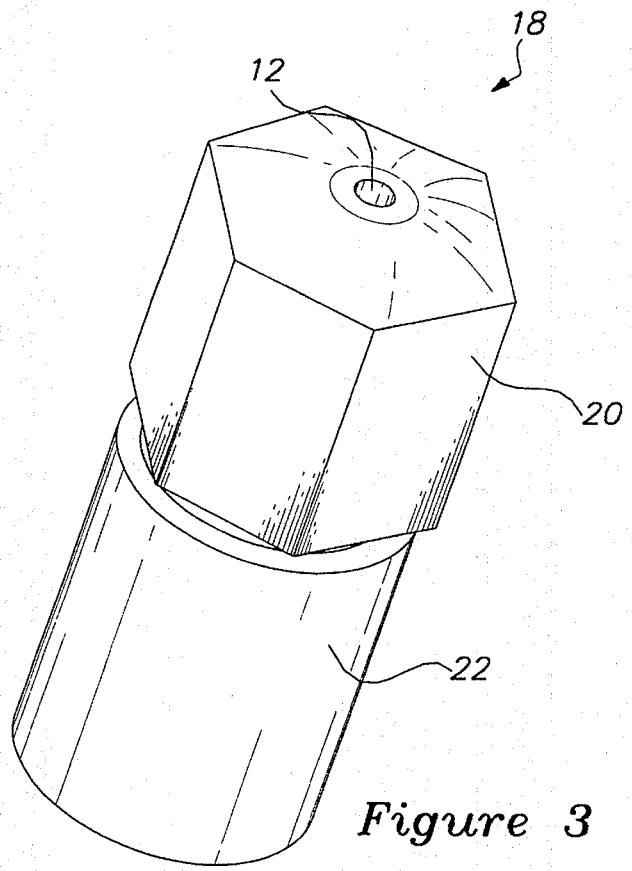
FIG. 3 is an isometric side view of the housing containing the chamber.

FIG. 3 depicts an isometric side view of the housing 18 containing the chamber. In FIG. 3, the upper section 20 has been threaded onto the lower section 22 so as to complete the housing and the chamber located therein. Orifice 12 can be seen located at the upper end of the housing 18.

FIG. 4 depicts a lightweight, portable, liquid fuel component stove suitable for backpacking having a burner assembly 36 containing weighted needle 8, thereby showing a possible location for it in such a liquid fuel component stove. The component burner assembly 36 contains the portable fuel delivery system 2 and a burner 4, and the burner assembly 36 is detachably connected via a fuel line 6 to a standalone fuel container 38, such as a fuel bottle. The fuel container 38 is preferably attached to the burner assembly 36 via a clamp located at the junction of fuel line 6 and fuel container 38, but a clamp located at the junction of fuel line 6 and stove 36 (or at a point along fuel line 6 where the fuel line continues into the burner assembly 36), as well as other releasable connections known in the art, is also suitable for attachment.

The weighted needle 8 is particularly useful with a lightweight, liquid fuel component stove, such as depicted in FIG. 4, because the fuel container 38 may be removed from the burner assembly 36 prior to cleaning, such as where the orifice 12 clogs while in use, thereby lessening the possibility that fuel will leak while shaking and contact the hot stove. Alternatively, the fuel container 38 may be attached to the burner assembly 36 after cleaning, such as when the burner assembly 36 is removed from a backpack and has not yet been "fired up." Such "after cleaning" attachment of the burner assembly 38 and the fuel container 38 again lessens the possibility that fuel will leak. The use of the weighted needle 8 in conjunction with a component stove also provides a lighter, more easily manipulated component for shaking when compared to a single unit stove (or other burning appliance, such as a lantern). Further, the weighted needle is particularly advantageous when used with liquid fuels because, when traveling in remove areas, very "dirty" liquid fuels are often the only available fuels. Such liquid fuels therefore clog the orifice 12 with great frequency.

In accordance with these advantages, the present invention provides, in a further aspect, a method for cleaning the fuel delivery system comprising detaching a liquid fuel container from a burner assembly containing the fuel delivery system, preferably by releasing a clamp securing the burner assembly and the fuel container one to the other, then shaking the burner assembly such that a weighted needle is shaken in and out of an orifice that transmits fuel from the chamber to the burner of the burner assembly. In an alternative embodiment, the order of the method is reversed, in that the liquid fuel container is attached to the burner assembly after the burner assembly has been shaken to effect cleaning by the weighted needle.

The present embodiments of this invention are to be considered in all respects as illustrative and not restrictive, the scope of the invention being indicated by the appended claims rather than by the foregoing description, and all changes that come within the meaning and range of equivalency of the claims therefore are intended to be embraced therein.

What is claimed is:

1. A lightweight, portable, liquid fuel component stove comprising a burner assembly detachably connected via a fuel line to a stand-alone liquid fuel container, said burner assembly comprising a fuel delivery system having a chamber able to transmit fuel to a burner, said chamber containing a weighted needle having a cleaning end sized to fit an orifice that transmits fuel to said burner, said orifice located in a wall of said chamber, said cleaning end able to move within said orifice upon shaking said chamber, and said cleaning end allowing transmission of said fuel through said orifice when said fuel delivery system is stationary and upright.

2. The lightweight, portable, liquid fuel component stove of claim 1 wherein a tube contains said housing, said tube having an opening that allows air to be mixed with said fuel prior to burning at said burner, and said orifice connects said chamber with said opening.

3. The lightweight, portable, liquid fuel component stove of claim 1 wherein said chamber is located below said burner and said orifice is located in a wall of said chamber proximal to said burner.

4. The lightweight, portable, liquid fuel component stove of claim 1 wherein a spring is disposed between an end of said chamber having said orifice and said weighted needle.

5. The lightweight, portable, liquid fuel component stove of claim 1 wherein said cleaning end is removed from said orifice by gravity when said fuel delivery system is stationary and upright.

6. The lightweight, portable, liquid fuel component stove of claim 1 wherein said weighted needle effectively terminates the flow of fuel to said burner when said chamber is not stationary and upright.

7. A method for cleaning a fuel delivery system contained within a lightweight, portable, liquid fuel component stove comprising a burner assembly detachably connected via a fuel line to a stand-alone liquid fuel container, the method comprising:

(a) detaching said liquid fuel container from said burner assembly, said burner assembly containing said fuel delivery system, then (b) shaking said burner assembly such that a cleaning end of a weighted needle contained within a chamber that transmits fuel in said fuel delivery system cleans an orifice that transmits fuel to a burner of said burner assembly, said orifice located in a wall of said chamber.

8. A method for cleaning a fuel delivery system contained within a lightweight, portable, liquid fuel component stove comprising a burner assembly detachably connected via a fuel line to a stand-alone liquid fuel container, the method comprising:

(a) shaking a burner assembly that is a component of said stove and contains a fuel delivery system such that a cleaning end of a weighted needle contained within a chamber that transmits fuel in said fuel delivery system cleans an orifice that transmits fuel to a burner of said burner assembly, said orifice located in a wall of said chamber; then (b) attaching said liquid fuel container to said burner assembly.

* * * * *